US005862440A

United States Patent [19]

Christy et al.

[11] Patent Number: 5,862,440

[45] Date of Patent: Jan. 19, 1999

[54] TONER DELIVERY DEVICE

[75] Inventors: Orrin D. Christy, North Tonawanda; Mark A. Muranyi; Kevin J. Hook, both of Grand Island, all of N.Y.

[73] Assignee: Moore Business Forms, Inc., Grand Island, N.Y.

[21] Appl. No.: 837,328

[22] Filed: Apr. 11, 1997

[51] Int. Cl.[6] ..... G03G 21/00

[52] U.S. Cl. ..... 399/99; 399/283

[58] Field of Search ..... 399/92, 98, 99, 399/281, 283, 285, 291, 292, 282, 293, 273

[56] References Cited

U.S. PATENT DOCUMENTS

| | | | |
|---|---|---|---|
| 4,351,604 | 9/1982 | Karasawa et al. | 399/232 |
| 4,378,158 | 3/1983 | Kanbe | 399/281 |
| 4,508,052 | 4/1985 | Kohyama | 399/282 |
| 4,746,796 | 5/1988 | Heigi . | |
| 4,777,106 | 10/1988 | Fotland . | |
| 4,984,019 | 1/1991 | Folkins . | |
| 5,023,748 | 6/1991 | Okamoto et al. . | |
| 5,028,959 | 7/1991 | Gooray . | |
| 5,134,442 | 7/1992 | Folkins et al. . | |
| 5,253,016 | 10/1993 | Behe et al. | 399/103 |
| 5,270,782 | 12/1993 | Floyd, Jr. | 399/281 |
| 5,321,474 | 6/1994 | Bares . | |
| 5,337,131 | 8/1994 | Sagiv et al. . | |
| 5,392,099 | 2/1995 | Kusumoto et al. . | |
| 5,532,100 | 7/1996 | Christy et al. | 430/120 |
| 5,630,200 | 5/1997 | Christy | 399/228 |

FOREIGN PATENT DOCUMENTS

| | | |
|---|---|---|
| 494 454 | 7/1992 | European Pat. Off. . |
| 5-346728 | 12/1993 | Japan . |
| WO 96 39647 | 12/1996 | WIPO . |

OTHER PUBLICATIONS

Patent Abstracts of Japan vol. 012, No. 345, 16 Sep. 1988 & JP 63 101873 A, May 1988.

*Primary Examiner*—Robert Beatty
*Attorney, Agent, or Firm*—Nixon & Vanderhye, P.C.

[57] ABSTRACT

A system for the delivery of a substantially uniform mono-layer of toner to an electrostatic latent image in an imaging member (such as a rotating cylinder) insures proper handling of the toner, and utilizes first and second rollers which function as a polarity filter for toner, allowing only particular charged toner to be transferred from a toner reservoir to the imaging member. The twin roller delivery system comprises first and second rollers mounted for rotation about substantially parallel substantially horizontal axes, so that the peripheral surface of the first roller receives the toner from the substantially open top reservoir, and the second roller receives toner from the first roller and transfers it to the imaging member. The first and second rollers are charged to different electrical potentials, e.g. both being positive with the second roller at a potential that is about 400 volts below the first. The rollers are rotated in opposite directions about the axes of rotation. Toner scraping is provided at specific points along the first and second rollers so that any residual toner falls into the toner reservoir, and a suction system is provided adjacent the second roller both before and after its peripheral surface transfers toner to the imaging member, to remove stray toner without disturbing the substantially uniform mono-layer of toner.

18 Claims, 3 Drawing Sheets

TONER DELIVERY DEVICE

BACKGROUND AND SUMMARY OF THE INVENTION

European patent specification 494454 discloses an apparatus and method for applying non-magnetic and non-conductive toner to an imaging member containing an electrostatic pattern, for ultimately imaging substrates, such as a moving paper web. The system as disclosed therein (the disclosure of which is hereby incorporated by reference herein) utilizes a fluidized bed of toner, a roller system for transferring the toner to an imaging member (the rollers having various electrical potentials), and a mechanism for replenishing the toner in the fluidized bed. While the system described therein is highly useful, there are some circumstances when a simpler system is desired for application of the charged toner to the imaging member, such as in a Moore Business Forms, Inc. (of Lake Forest, Ill.) Midax 300 printing engine, and there are systems in which it is desirable to insure that a uniform mono-layer of toner is undisturbed until the layer is delivered to the imaging member, and any unused toner is returned directly to the toner reservoir. The present invention provides a system for accomplishing these purposes.

According to the present invention in a single component non-magnetic toner applicator system charged toner is delivered to an electrostatic latent image on an imaging member (such as an imaging roller) by a dual conductive roller system. Utilizing electric fields and electrostatic adhesion forces in succession, toner is transported from the reservoir of charged toner to a latent image. The roller system, shields, and vacuum (suction) system according to the invention are configured in such a way that a uniform mono-layer of toner is undisturbed until the layer is delivered to a point in opposition to the latent image on the imaging member, where it subsequently develops the image, and the untransferred residual toner is returned directly to the toner reservoir for reuse. The twin rollers act as a polarity filter for the toner only allowing particularly charged (positively charged in the description provided in the application, but the invention also being applicable to negatively charged systems) to be transferred between the rollers, thus eliminating the adverse affects of having negative toner strain throughout the imaging system. The dual roller system according to the invention also allows great flexibility in delivering the images in a wide variety of positions including the seven o'clock position, the six o'clock position, and essentially any position between about two and ten o'clock, providing a wide variety of possible configurations for a multitude of applications in electrophotography and electrography.

According to one aspect of the present invention a system for the delivery of a substantially uniform mono-layer of toner to an electrostatic latent image on the imaging member is provided comprising the following components: A toner reservoir containing a fluidized bed of charged toner and having a substantially open top. An imaging member. A (e.g. twin) roller delivery system for delivery of a substantially uniform mono-layer of toner to an electrostatic latent image on the imaging member, comprising first and second rollers mounted for rotation about substantially parallel substantially horizontal axes, each roller having a peripheral surface. The first roller positioned so that the peripheral surface thereof receives toner from the substantially open top of the reservoir, and the second roller positioned so that the peripheral surface thereof receives toner from the first roller (e.g. directly from the peripheral surface thereof), and so that the second roller peripheral surface transfers toner directly to the imaging member. Means for charging the first and second rollers to different electrical potentials. Means for rotating the first and second rollers (e.g. in opposite directions of rotation) about the axes. Means for scraping toner from the first roller peripheral surface between the second roller and the reservoir at a portion of the first roller peripheral surface past the second roller in the direction of rotation of the first roller, so that the toner falls into the toner reservoir and does not escape into the surrounding environment. And means for scraping toner from the second roller peripheral surface after transfer of toner therefrom (e.g. to the second roller) so that toner falls into the toner reservoir and does not escape into the surrounding environment.

The toner scraping means may comprise any suitable conventional scraping devices, such as conventional scraper blades (rigid or flexible), or scraper blades associated with gas blasts and/or suction sources, and/or mounted within particular configured shields and housings so as to positively redirect the toner to the toner reservoir.

The means for charging the first and second rollers may be any conventional electrical potential sources. They may charge the rollers so that they are both at positive potentials, typically with the second roller at an electrical potential lower than the first. For example, the charging means may maintain the second roller at a potential that is about 300–500 volts (e.g. about 400 volts) below the first roller. For example, the first roller could be charged to a potential between about 400–500 volts (positive), with the second roller between about 100–700 volts (positive).

Suction means are preferably also provided adjacent the second roller both before and after the second roller peripheral surface transfers toner to the imaging member in the direction of rotation thereof, so as to remove stray toner without disturbing the substantially uniform mono-layer of toner. The suction means may comprise any conventional vacuum source with any desired channels configured to withdraw the stray toner from unwanted positions to a disposal site.

The means for rotating the rollers may comprise any conventional power source including electrical motors, fluid driven motors, belts and pulleys, chains and sprockets, gears or the like. The second roller preferably transfers toner to the imaging member at approximately a seven o'clock position, or at a six o'clock position. Desirably the first roller axis of rotation is both horizontally and vertically spaced from the second roller axis of rotation.

The first and second rollers are preferably positioned and charged by the charging means so that the rollers function as a polarity filter for toner, allowing only particularly charged toner to be transferred from the toner reservoir to the imaging member. The first and second rollers are typically positioned so that there is a gap between them that is of substantial uniform with, e.g. between about 100–250 microns.

According to another aspect of the present invention a system is provided comprising the following components: A toner reservoir containing a bed of charged toner and having a substantially open top. An imaging member. A (e.g. twin) roller delivery system for delivery of a substantially uniform mono-layer of toner to an electrostatic latent image on the imaging member, comprising first and second rollers mounted for rotation about substantially parallel substantially horizontal axes, each roller having a peripheral surface. The first roller positioned so that the peripheral surface thereof receives toner from the substantially open top of the reservoir, and the second roller positioned so that the peripheral surface thereof receives toner from the first roller (e.g. directly from the peripheral surface thereof), and so that the second roller peripheral surface transfers toner directly to the imaging member. Means for charging the first and second rollers to different electrical potentials. Means for rotating the first and second rollers about their axes of rotation. And suction means provided adjacent the second roller both before and after the second roller peripheral surface transfers toner to the imaging member in the direction of rotation thereof, so as to remove stray toner without disturbing the substantially uniform mono-layer of toner. The details of the components preferably are such as described above.

According to yet another aspect of the present invention a system is provided comprising the following components: A toner reservoir containing a fluidized bed of charged toner and having a substantially open top. An imaging member. A twin roller delivery system for delivery of a substantially uniform mono-layer of toner to an electrostatic latent image on the imaging member, consisting of first and second rollers mounted for rotation about substantially parallel substantially horizontal axes, each roller having a peripheral surface. The first roller positioned so that the peripheral surface thereof receives toner from the substantially open top of the reservoir, and the second roller positioned so that the peripheral surface thereof receives toner directly from the first roller peripheral surface, and so that the second roller peripheral surface transfers toner directly to the imaging member. Means for charging the first and second rollers to different electrical potentials. Means for rotating the first and second rollers in opposite directions of rotation about the axes. And wherein the first and second rollers are positioned and charged by the charging means so that the rollers function as a polarity filter for toner, allowing only particularly charged toner to be transferred from the toner reservoir to the imaging member. Preferably, the first and second rollers are positioned so that the axes thereof are both horizontally and vertically offset from each other and so that there is a gap therebetween that has a substantially uniform width between about 100–250 microns. The other details of the system preferably are as described above.

It is the primary object of the present invention to provide a simple yet effective system for the delivery of a uniform mono-layer toner to an electrostatic latent image on an imaging member. This and other objects of the invention will become clear from an inspection of the detailed description of the invention and from the appended claims.

DETAILED DESCRIPTION OF THE DRAWINGS

Figure 1:
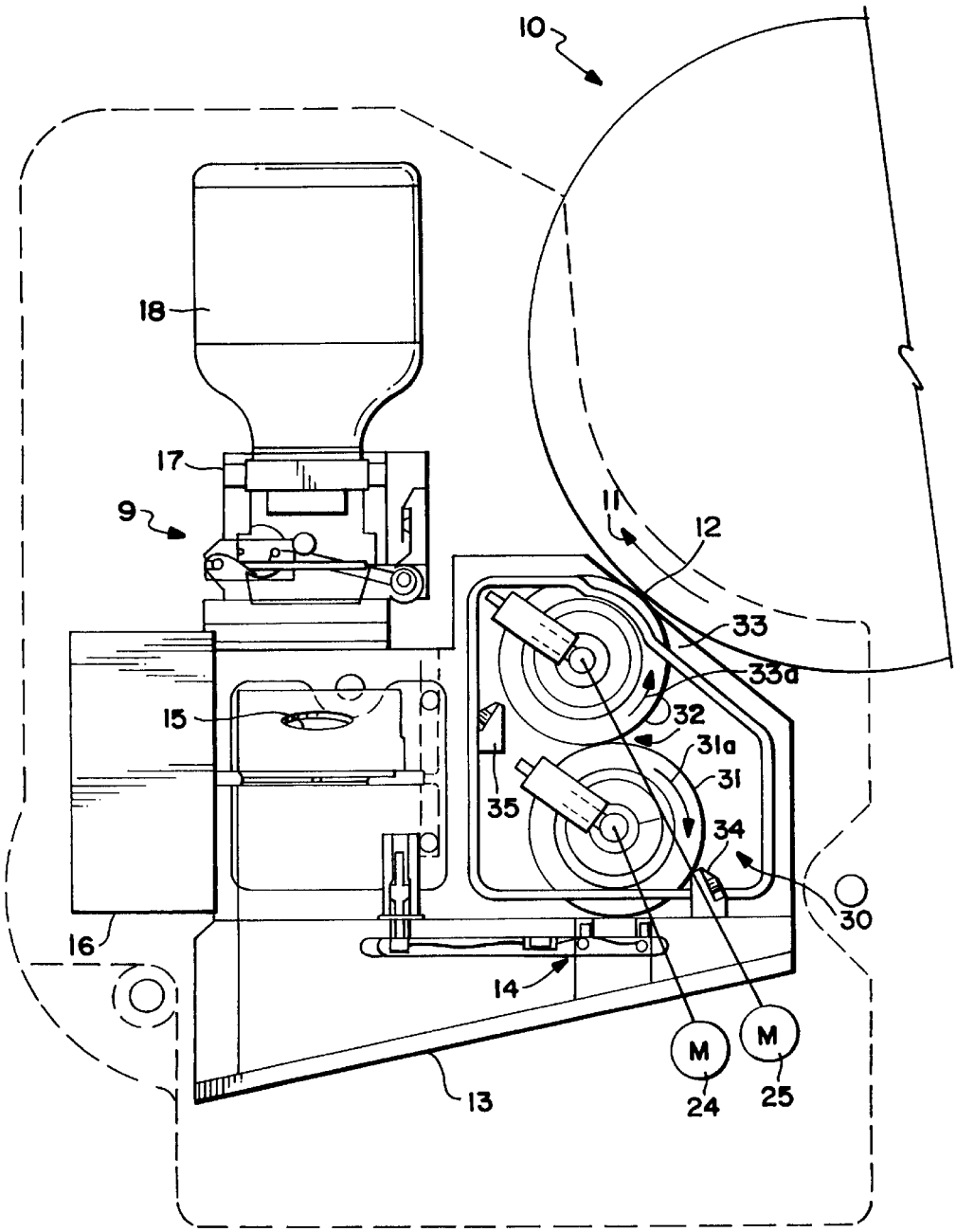
FIG. 1 is a side view, with portions of the casing removed for clarity of illustration, of a first embodiment of an exemplary toner delivery system according to the present invention.

Referring to FIG. 1, the developer station 9 is mounted in a printing engine so that toner development takes place on the imaging member 10 at position 12. Rotation of the imaging member is clockwise as indicated by arrow 11. The imaging member 10 may be of many different configurations; in FIG. 1 the imaging member 10 is a cylinder. In a preferred embodiment the cylinder 10 is a photoconductive drum with a background potential (non-image area) of about +550 volts and an image potential of about +60 volts. The exact values and polarities are unimportant as the developer station 9 and the toner charging method can easily adapt to many different potential level configurations. Imaging member 10 may also be a dielectric belt, a dielectric cylinder, or a photoconductive belt, so long as sufficient contrast potential (voltage) exists between the background and image areas to adequately attract the charged toner selectively in the image areas.

The developer station 9 includes as primary components a toner reservoir 13 which is, as shown in EP 494454, preferably a fluidized bed of charged toner, and a delivery roller system 30 which carries a uniform mono-layer of toner to the image development position 12 on the imaging member 10. While in the reservoir 13, the toner is charged by high voltage corona devices 14 under the surface of the level of the fluidized toner and is delivered to the first roller, or the transfer roller 31 in the roller system 30, by the electric field set up between the corona devices 14 and the roller 31. The corona devices 14 may be such as disclosed in EP 494454, or such as disclosed in copending application Ser. No. 08/629,089 filed Apr. 8, 1996 (Attorney Reference 263-1445, 96-13), the disclosure of which is hereby incorporated by reference herein, or may be any one of a wide variety of conventional corona devices.

The level of the toner above the corona wires 14 and below the transfer roller 31 is monitored by non-contacting sonic sensors 15. The sonic signal is processed in the conventional control electronics 16. When the level of the toner drops below the set point, the electronics 16 send a signal to the air driven dispenser 17, which dispenses a measured amount of toner from the upper reservoir 18, e.g. an inverted storage bottle mounted in the dispenser. After the dispensed toner reaches the lower fluidized reservoir 13, the sensor 15 once again tests the bed level to determine if the set point has been reached.

In the developer roller system 30 charged toner is transported to the surface of the transfer roller 31 by the electric field set up between the charging corona devices 14 and the transfer roller 31. The mono-layer of toner formed on the roller 31 is transported clockwise as indicated by direction arrow 31*a* until it rotates to a position 32 in opposition to the second roller 33 (which will be referred to as the applicator roller). At the closest point 32, an electric field exists which is created by the difference in electrical potential between the two rollers 31, 32 and the toner is transported uniformly to the applicator roller 33 which is rotating in a counter-clockwise direction as indicated by arrow 33*a*.

The applicator roller 33 transports the toner around to the imaging member 10 where it makes its closest approach at point 12. Here, like at point 32, toner is transported to the imaging member when a potential difference forms an electric field between the applicator roller 33 and the latent image on the imaging member 10. The surface speed of the transfer roller 31 and the applicator roller 33 matches that of the imaging member 10.

The rollers 31, 33 are rotated by means for rotating the rollers 31, 33 in opposite directions of rotation about substantially parallel substantially horizontal axes. These rotating units are shown schematically at 24 and 25 in FIG. 1 and may comprise any suitable power components, such as conventional electric motors, a single electric motor with appropriate gearing, sprockets, or pulleys, fluid motors, or any other type of power device or power transfer mechanisms including belts and pulleys, chains and sprockets, and gears of all types. The imaging member 10 is similarly powered by any conventional rotating or moving means depending upon the nature of the imaging member 10.

Figure 2:
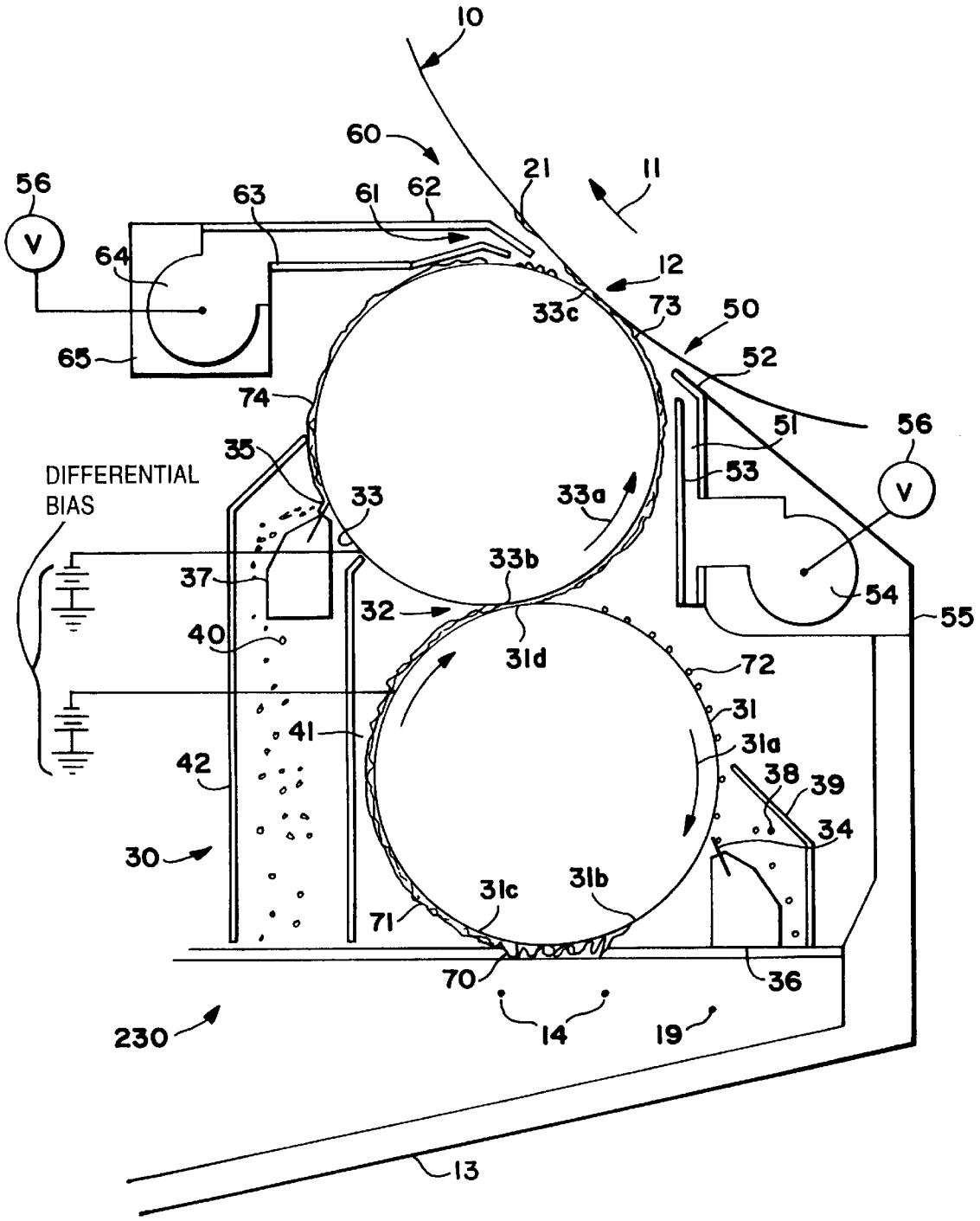
FIG. 2 is a detailed view of the roller elements of the system of FIG. 1 and showing, schematically, the transfer, scraping, and suction removal of toner, features associated therewith.

Residual untransferred toner is scraped off of each roller by scraper blades 34 and 35 of the scraper means preferably positioned as indicated in FIGS. 1 and 2. The blades 34, 35 are preferably rigid but may be flexible and may be associated with any other components to define the scraping means, such as conduits, mounts, suction devices, high pressure fluid blasts, or the like.

The environment within the chamber which contains the roller delivery system 30 can be an extremely dusty area which makes stray toner control extremely important to successful operation. Stray toner which is electrically charged is attracted to any surface and in time will build up a very thick coating which eventually will collect so much mass that it will fall off. This may be controlled by a vacuum stream but the disadvantage to a high vacuum draw is that it may affect print quality by disturbing the uniform layer of toner on the rollers and may also result in high toner consumption. According to the invention devices are used for insuring that the toner layer presented to the latent image on the imaging member 10 is undisturbed while operating in very dusty environment and is subject to possible large amounts of contamination.

FIG. 2 schematically illustrates the mechanism used to insure that the toner layer is not disturbed before its presentation to the latent image on the imaging member 10 and the control of stray toner by the proper use of shields and vacuum channels. The toner 19 is in a fluidized state in the lower reservoir 13. High voltage corona devices 14 inject an electrostatic charge onto the toner particles by a process known as field charging or Pauthenier charging. The charged toner particles, reacting to the electric field formed between the corona devices 14 and the transfer roller 31, are transported to the surface of the roller 31 through the transport area 70 and are deposited onto the roller 31 forming a very uniform mono-layer of toner 71 in the region of the roller 31 periphery between the development points 31*c* and 31*b*. The particles attach themselves to the roller 31 by an electrostatic adhesion force. The layer of toner 71 is held by this force while rotating in a clockwise direction as noted by the arrow 31*a*. This layer 71 must remain undisturbed until it reaches the transfer point 31*d* in the nip area 32 between the two rollers 31, 33.

Typically the corona devices 14 operate at a potential from between about +6.0 kVolts up to about +10.0 kVolts and develop a charge-to-mass ratio on the toner ranging from about 8.0 $\mu$Coulombs/gram to about 25.0 $\mu$Coulombs/gram. The transfer roller 31 may be a hard conductive cylinder typically which operates a potential of about +400 volts to about +1000 volts. E.g., the potential of the transfer roller is held at about +900 volts. Even though the transfer roller 31 is not at ground potential, the field between it and the corona devices 14 is about 2.0 V/$\mu$M and easily results in transfer of the toner to the surface of the roller 31.

The toner layer 71 enters the nip area 32 between the two rollers 31, 33 and is subjected to an electric field force formed by the potential difference between the transfer roller 31 and the applicator roller 33. The gap between the two rollers 31, 33 is preferably between about 100 microns and 250 microns. The applicator roller 33 is at a voltage potential approximately 300–500 (e.g. about 400) volts below the transfer roller 31 and when the electric field force on the toner exceeds the electrostatic adhesion force of the toner onto the roller surface, it is transferred to the applicator roller 33 at point 33*b*. For example, the applicator roller 33 is held at a potential of +520 volts. The toner adheres to the applicator roller 33 by the electrostatic adhesion force and the uniform layer of toner is rotated from point 33*b* to the image development point in a counter-clockwise direction as indicated by arrow 33*a*.

Between points 33*b* and 33*c*, it is again necessary to prevent any disturbance to the toner layer on the applicator roller 33. At the point 33*c*, the electrostatic latent image on the imaging member 10 is developed from the uniform layer of charged toner on the applicator roller 33 by the electric field created by the difference of the voltage potential of the latent image and the voltage potential on the applicator roller 33. A desired electric field of between about 1.0 to 3.0 volts/micron between the applicator roller 33 and the latent image will create an electric field force strong enough to overcome the electrostatic adhesion force holding the toner onto the applicator roller 33 and that imaging part of the uniform toner layer is transferred to the latent image at position 12. In usual operation, proper image development is achieved when the latent electrostatic image on the imaging member is approximately 400 volts below the potential on the applicator roller with a gap between the roller 33 and the imaging member 10 at position 12 in a range between about 50 and 250 microns. E.g., the latent image potential is about +60 volts over a background image potential of about +550 volts. The minimum gap between the applicator roller 33 and the imaging member 10 at point 12 is 100 microns for this example.

The imaging member 10 of FIG. 1 is a cylinder rotating in the clockwise direction as indicated by arrow 11. The developed latent image then carries away the toner layer 21 and is subsequently transferred to a substrate to be imaged (e.g. such as paper web 43 in EPO 494454), and fused onto the substrate by means of heat, pressure, or both. The surface speeds of the transfer roller 31 and the applicator roller 33 are matched to travel at the same surface speed as the imaging member 10.

In an alternate prophetic configuration the hard conductive applicator roller 33 may be replaced by a conductive or semiconductive elastomeric roller. The gaps between the transfer roller 31 and the applicator roller 33, and between the applicator roller 33 and imaging member 10, would then be reduced to a zero clearance gap. In this configuration, contact transfer between the electrically biased members would be implemented.

The process of toner transfer leaves a residual untransferred layer of toner on both rollers 31, 33, and some of the toner becomes airborne and vectors away from each of the transfer points. On the transfer roller 31, the residual toner 72 which remains is scraped off by scraper blade 34 which is held in a rigid holding member 36. To prevent further vectoring of the toner from the area of scraping, a toner return chamber 38 is formed by a toner vectoring shield 39 and the scraper blade holding assembly 36, the elements 38, 39, 36 forming part of the scraping means. The scraped toner off of the transfer roller 31 returns directly to (falls into) the lower toner reservoir 13 while captivated within the said toner return chamber 38.

Residual toner layer 74 on the applicator roller 33 is scraped off of the roller 33 by means of a substantially identical apparatus as found on the transfer roller 31, as described above. The scraping blade 35 held in a rigid mount 37 scrapes the residual toner off of the roller 33 where it drops into the toner return chamber 40 formed by the containing inner shield 41 and the containing outer shield 42. The toner is returned directly to the lower toner reservoir 13.

Stray airborne toner which is able to escape from the controlling electrostatic forces must be removed to prevent build-up on inner surfaces of the developer station. The critical area is around the development area of the latent image. To remove any of the stray toner particles, suction means, preferably in the form of two vacuum knife assemblies 50, 60, are provided. The lower vacuum knife assembly 50 is formed by an outer containing wall 52 and an inner containing wall 53 which forms a vacuum chamber 51. A vacuum source 56 (e.g. pump, venturi, etc.) external to the developer station is connected to plenum 54 within the vacuum block 55. The flow into the vacuum source 56 creates a downward air flow through the vacuum chamber 51 which carries away the stray toner from the development area 12.

In like fashion, an upper vacuum knife assembly 60 is formed with similar components as found in the lower assembly 50. The vacuum chamber 61 is formed by an upper containing shield 62 and a lower containing shield 63. The external vacuum source 56 is also connected to plenum 64 found within vacuum block 65 and creates a similar air flow in the vacuum chamber 61 to remove stray airborne from the other side of the development area 12. The assemblies 50, 60 form suction means for removal of stray toner without disturbing the substantially uniform mono-layer 71 of toner.

The placement of the components within the roller assembly area 30 is significant. The uniform charged toner layer 71 must remain undisturbed from point 31*c* where the coating process finishes all the way through to point 33*c* on the applicator roller where image development takes place. Disturbances which could affect the uniformity of the charged toner mono-layer 71 include droppage of toner clumps which have built up on internal surfaces of the developer station, excessively high air flows across the roller which can pull toner away, or excessively dense clouds of stray charged toner which the uniform layer 71 might need to pass through. Important to the process is the positioning of the surfaces vertically above the uniform toner layer as it delivers toner to the electrostatic latent image. From point 31*c* on the transfer roller 31 up to the point 31*d* where the toner layer transfers to the applicator roller 33, the surface vertically above the uniform toner layer 71 will be the clean scraped applicator roller.

The applicator roller 33 is void of charged toner from the scraping point at blade 35 through to the transfer point 33*b*. Similarly, no toner collecting surfaces exist vertically above the area of the applicator roller 33 between points 33*b* where the toner is received through to the development point 33*c*. Note also that the two rollers 31, 33 are offset slightly in the vertical dimension (their axes are both horizontally and vertically spaced from each other) to aid in the placement of the key components. Toner may build up on the inside surface of toner shields 53 or 63, but these accumulations will eventually drop to areas of the rollers 31, 33 which no longer need a uniform layer of charged toner. Here the toner will fall onto a roller and simply be scraped off by the respective scraper blades 34, 35 and returned to the lower toner reservoir 13.

Figure 3:
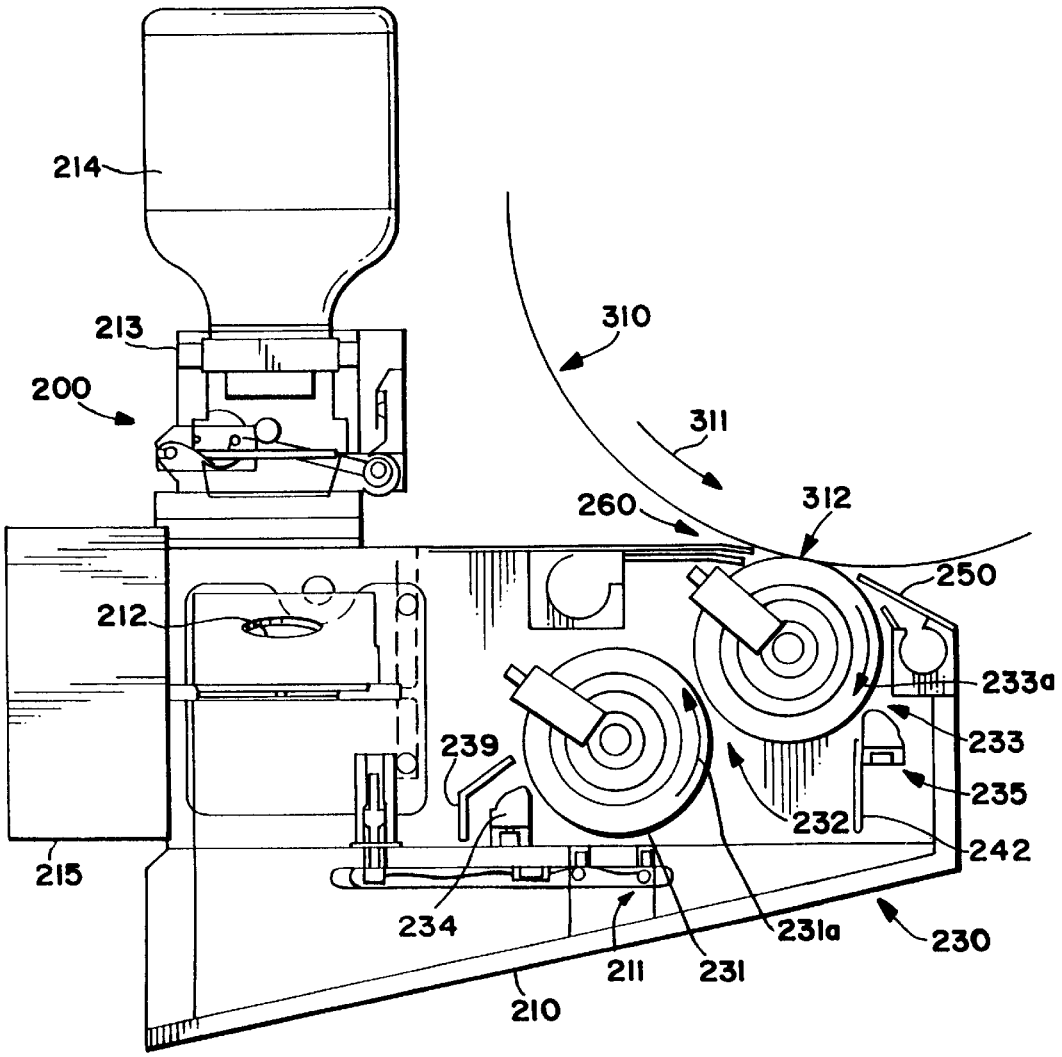
FIG. 3 is a view like that of FIG. 1 for another exemplary embodiment of the system according to the present invention.

FIG. 3 illustrates a prophetic example of how the configuration might be changed to accommodate a different development position (closer to the 6 o'clock position), a different imaging member 10 direction (counter-clockwise on the cylinder described in the example), and electrically adapt to other configurations of electrophotogaphic or electrographic printing engines. A variety of other prophetic examples are within the scope of the invention. It is important to maintain a broad array of possible configurations with different imaging members (cylinder, belt, electrical field ladder arrays, etc.), different imaging member directions (CW, CCW, upwards, downwards, beneath horizontally), different sets of imaging electrical parameters (potentials and polarities of background and image areas), and development points around the imaging member (limited between 2 o'clock through 10 o'clock contact angles and similar associated angles on belt imaging members).

In FIG. 3, developer station 200 maintains all of the same standard components as the developer station 9 found in FIG. 1. The roller system 230 has been repositioned to accommodate development of the electrostatic latent image on the imaging member 310 closer to the 6 o'clock position, and also adapting to a counter-clockwise rotation of the imaging member 310 as indicated by arrow 311. The transfer roller 231 and applicator roller 233 follow the same method for toner delivery to the latent image at point 312. The two rollers 231, 233 rotate in the opposite direction as seen for rollers 31, 33 in FIG. 1, as indicated by arrows 231*a* and 233*a*. Scraper blades 234 and 235 clean off the residual toner from the rollers in substantially the same way and as in the FIG. 1 embodiment containing shields 239 and 242 act to channel the toner vectoring from the scraper blades and return it back below to the lower toner reservoir 210. An upper vacuum knife assembly 260 and a lower vacuum knife assembly 250 act in a similar fashion to their counterparts 50, 60 as described in FIG. 2, to remove stray airborne toner particles near the development area 311.

The remaining components of the system like the toner dispenser 213, inverted toner bottle storage 214, and the electronic control may be disposed in alternative positions. The example illustrated is demonstrative of but one such possible combination of components.

In such a system, one might find by example that the high voltage corona devices 211 operate in a range from about +6.0 kVolts to about +10.0 kVolts dependent on the surface speed of the rollers and the imaging member 310. Positively charged toner will be transported via electric field to the transfer roller 231 which is biased to a potential of about +400 volts. Toner will be transferred to the applicator roller in the area 232 by an electric field created between the transfer roller 231 and applicator roller 233 which is at about a zero volts or ground potential. The charged toner layer is then transported to a point in opposition to the latent image on the imaging member 310 with the latent image at an electrical potential of about −350 volts on a background area potential of about +50 volts. The positive toner will be to the negative image areas via the electric field lines. Once the toner layer is on the imaging member 310, it will be transferred to the paper substrate and fused in place.

It will thus be seen that according to the present invention a simple yet effective system for the delivery of a uniform mono-layer of toner to an electrostatic latent image on an imaging member 10 (310) is provided. The system utilizes first and second rollers 31, 33 (231, 233) which are positioned and charged by a source of electrical potential so that the rollers function as a polarity filter for toner, allowing only particularly charged toner to be transferred from the toner reservoir 13 (210) to the imaging member 10 (310). While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and systems.

What is claimed is:

1. A system for the delivery of a substantially uniform mono-layer of toner to an electrostatic latent image on an imaging member, comprising:

a toner reservoir containing a fluidized bed of charged toner and having an opening;

an imaging member;

a roller delivery system for delivery of a substantially uniform mono-layer of toner to an electrostatic latent image on said imaging member, comprising first and second rollers mounted for rotation about substantially parallel substantially horizontal axes, each roller having a peripheral surface;

said first roller positioned so that said peripheral surface thereof receives toner from said opening of said reservoir, and said second roller positioned so that said peripheral surface thereof receives toner from said first roller, and so that said second roller peripheral surface transfers toner directly to said imaging member;

means for charging said first and second rollers to different electrical potentials;

means for rotating said first and second rollers about said axes;

means for scraping toner from said first roller peripheral surface between said second roller and said reservoir at a portion of said first roller peripheral surface after transfer of toner therefrom, so that the toner falls into said toner reservoir and does not escape into the surrounding environment;

means for scraping toner from said second roller peripheral surface between said imaging member and said first roller in the direction of rotation of said second roller so that toner falls into said toner reservoir, and does not escape into the surrounding environment, wherein each said scraping means comprises at least one scraper blade, holder, chamber, and shield; and suction means provided adjacent said second roller both before and after said second roller peripheral surface transfers toner to said imaging member in the direction of rotation thereof, so as to remove stray toner without disturbing the substantially uniform mono-layer of toner.

2. A system as recited in claim 1 wherein said means for charging said first and second rollers charges them so that they are both at positive potentials, said second roller at a potential lower than said first roller.

3. A system as recited in claim 2 wherein said means for charging maintains said second roller at a potential that is about 300–500 volts below said first roller.

4. A system as recited in claim 1 wherein said first and second rollers are positioned and charged by said charging means so that said rollers function as a polarity filter for toner, allowing only particularly charged toner to be transferred from said reservoir to said imaging member, said first and second rollers being hard surfaced and positioned so that there is a gap therebetween that has a substantially uniform width between about 100–250 microns.

5. A system as recited in claim 1 wherein said rotating means rotates said first roller clockwise, and said second roller counterclockwise, and wherein said imaging member comprises a cylinder rotating clockwise.

6. A system as recited in claim 1 wherein said second roller transfers toner to said imaging member at approximately a seven o'clock position with respect to said imaging member, and wherein said first roller axis of rotation is horizontally and vertically spaced from said second roller axis of rotation.

7. A system as recited in claim 1, wherein said means for charging said first and second rollers charges them so that they are both at positive potentials, said second roller at a potential lower than said first roller.

8. A system as recited in claim 1 further comprising suction means provided adjacent said second roller both before and after said second roller peripheral surface transfers toner to said imaging member in the direction of rotation thereof, so as to remove stray toner without disturbing the substantially uniform mono-layer of toner.

9. A system as recited in claim 1 wherein said imaging member is engaged by said second roller at approximately a six o'clock position, and wherein said first roller axis of rotation is horizontally spaced from said second roller axis of rotation.

10. A system for the delivery of a substantially uniform mono-layer of toner to an electrostatic latent image on an imaging member, comprising:

a toner reservoir containing a bed of charged toner and having an opening;

an imaging member;

a roller delivery system for delivery of a substantially uniform mono-layer of toner to an electrostatic latent image on said imaging member, comprising first and second rollers mounted for rotation about substantially parallel substantially horizontal axes, each roller having a peripheral surface;

said first roller positioned so that said peripheral surface thereof receives toner from said opening of said reservoir, and said second roller positioned so that said peripheral surface thereof receives toner from said first roller, and so that said second roller peripheral surface transfers toner directly to said imaging member;

means for charging said first and second rollers to different electrical potentials;

means for rotating said first and second rollers about said axes;

means for scraping toner from said first and second rollers, wherein said scraping means comprises at least one scraper blade, holder, chamber, and shield; and suction means provided adjacent said second roller both before and after said second roller peripheral surface transfers toner to said imaging member in the direction of rotation thereof, so as to remove stray toner without disturbing the substantially uniform mono-layer of toner.

11. A system as recited in claim 10 wherein said first and second rollers are positioned and charged by said charging means so that said rollers function as a polarity filter for toner, allowing only particularly charged toner to be transferred from said toner reservoir to said imagine member, said first and second rollers being hard surfaced and positioned so that there is a gap therebetween that has a substantially uniform width between about 100–250 microns.

12. A system as recited in claim 11 wherein said means for charging said first and second rollers charges them so that they are both at positive potentials, said second roller at a potential lower than said first roller.

13. A system as recited in claim 12 wherein said means for charging maintains said second roller at a potential that is about 300–500 volts below said first roller wherein said first roller is charged to a potential between about 400–1000 volts.

14. A system for the delivery of a substantially uniform mono-layer of toner to an electrostatic latent image on an imaging member, comprising:

a toner reservoir containing a fluidized bed of charged toner and having an opening;

an imaging member;

a twin roller delivery system for delivery of a substantially uniform mono-layer of toner to an electrostatic latent image on said imaging member, consisting of first and second rollers mounted for rotation about substantially parallel substantially horizontal axes, each roller having a peripheral surface;

said first roller positioned so that said peripheral surface thereof receives toner from said opening of said reservoir, and said second roller positioned so that said peripheral surface thereof receives toner directly from said first roller peripheral surface, and so that said second roller peripheral surface transfers toner directly to said imaging member;

means for charging said first and second rollers to different electrical potentials;

means for rotating said first and second rollers in opposite directions of rotation about said axes;

means for scraping toner from said first and second rollers, said means comprising at least one scraper blade, holder, chamber and shield, wherein said first and second rollers are positioned and charged by said charging means so that said rollers function as a polarity filter for toner, allowing only particularly charged toner to be transferred from said toner reservoir to said imaging member.

15. A system as recited in claim 14 wherein said means for charging said first and second rollers charges them so that they are both at positive potentials, said second roller at a potential lower than said first roller.

16. A system as recited in claim 15 wherein said means for charging maintains said second roller at a potential that is about 300–500 volts below said first roller.

17. A system as recited in claim 16 wherein said first roller is charged to a potential of between about 400–1000 volts.

18. A system as recited in claim 14 wherein said first and second rollers are positioned so that there is a gap therebetween that has a substantially uniform width between about 100–250 microns, and so that the axes thereof are both horizontally and vertically spaced from each other, and so that said second roller is positioned adjacent said imaging member so that there is a gap therebetween of between about 50–250 microns.

* * * * *